US011371744B2

(12) United States Patent
Frantz

(10) Patent No.: US 11,371,744 B2
(45) Date of Patent: Jun. 28, 2022

(54) CEILING SYSTEM WITH AIR MOVEMENT

(71) Applicant: ARMSTRONG WORLD INDUSTRIES, INC., Lancaster, PA (US)

(72) Inventor: William H. Frantz, Elizabethtown, PA (US)

(73) Assignee: AWI Licensing LLC, Wilmington, DE (US)

( * ) Notice: Subject to any disclaimer, the term of this patent is extended or adjusted under 35 U.S.C. 154(b) by 157 days.

(21) Appl. No.: 16/333,181

(22) PCT Filed: Sep. 14, 2017

(86) PCT No.: PCT/US2017/051571
§ 371 (c)(1),
(2) Date: Mar. 13, 2019

(87) PCT Pub. No.: WO2018/053136
PCT Pub. Date: Mar. 22, 2018

(65) Prior Publication Data

US 2019/0242611 A1 Aug. 8, 2019

Related U.S. Application Data

(60) Provisional application No. 62/395,035, filed on Sep. 15, 2016.

(51) Int. Cl.
*F24F 7/06* (2006.01)
*F24F 13/068* (2006.01)
(Continued)

(52) U.S. Cl.
CPC ..... *F24F 13/068* (2013.01); *E04B 9/02* (2013.01); *F24F 13/075* (2013.01); *F24F 13/08* (2013.01); *F24F 13/18* (2013.01)

(58) Field of Classification Search
CPC .. E04B 9/02; E04B 9/34; F24F 13/068; F24F 13/075; F24F 13/08; F24F 13/18
(Continued)

(56) References Cited

U.S. PATENT DOCUMENTS 2,180,945 A * 11/1939 Morey ..... E04B 9/02 454/297
2,704,864 A * 3/1955 Miles ..... E04B 9/34 52/145
(Continued)

FOREIGN PATENT DOCUMENTS

CN 2787896 Y 6/2006
EP 0531674 A2 3/1993
(Continued)

OTHER PUBLICATIONS

10 Unique Ceiling Fans, ODDEE, Jan. 23, 2014.

*Primary Examiner* — Brian E Glessner
*Assistant Examiner* — James J Buckle, Jr.
(74) *Attorney, Agent, or Firm* — Craig M. Sterner

(57) ABSTRACT

A ceiling system is provided that has a ceiling structure suspended within a space of a building thereby dividing the space into an occupied space below the ceiling structure and a plenum space above the ceiling structure; a panel structure supported by the ceiling structure and having an opening; a pressurized air passageway aligned with the opening, the pressurized air passageway having an outlet; and an inductive air passageway adjacent the pressurized air passageway, the inductive air passageway having an inlet and an outlet. Wherein the pressurized air passageway and the inductive air passageway are configured such that pressurized air passing through the outlet of the pressurized air passageway induces an induced air flow out of the outlet of the inductive air passageway.

18 Claims, 15 Drawing Sheets

(51) Int. Cl.
*F24F 13/075* (2006.01)
*F24F 13/08* (2006.01)
*E04B 9/02* (2006.01)
*F24F 13/18* (2006.01)

(58) Field of Classification Search
USPC ... 52/39, 220.6, 220.8, 243.1, 302.1, 506.06
See application file for complete search history.

(56) References Cited

U.S. PATENT DOCUMENTS 2,704,865 A * 3/1955 Siering ..... E04B 9/34 52/145
2,706,314 A * 4/1955 Siering ..... E04B 9/34 52/145
2,886,859 A * 5/1959 Siering ..... E04B 9/34 52/145
2,920,357 A * 1/1960 Ericson ..... E04B 9/065 454/298
2,973,703 A * 3/1961 Jack ..... F24F 7/10 454/296
2,996,138 A * 8/1961 Schwartz ..... F24F 13/068 181/284
3,033,097 A * 5/1962 Phillips ..... F24F 13/068 454/297
3,058,411 A * 10/1962 Hanson ..... F24F 7/10 454/296
3,069,991 A * 12/1962 Ericson ..... E04B 9/02 454/297
3,088,392 A * 5/1963 Egan ..... E04B 9/02 454/303
3,103,868 A * 9/1963 Kodaras ..... E04B 9/02 454/297
3,127,827 A * 4/1964 Ericson ..... F24F 13/072 454/303
3,200,734 A * 8/1965 Burns ..... E04B 9/045 454/297
3,204,547 A * 9/1965 Ericson ..... E04B 9/02 454/303
3,227,063 A * 1/1966 Lambert ..... F24F 13/072 454/299
3,301,163 A * 1/1967 Raider ..... F24F 13/068 454/248
3,325,954 A * 6/1967 Olson ..... E04B 9/241 52/302.1
3,390,624 A * 7/1968 Averill ..... E04B 9/02 454/304
3,409,766 A * 11/1968 Meckler ..... F21V 11/00 362/294
3,482,505 A * 12/1969 Dobbins ..... F24F 7/10 454/296
3,577,904 A 5/1971 Lambert
3,685,235 A * 8/1972 Lang ..... E04B 9/006 52/39
3,748,808 A * 7/1973 Sheppard ..... E04B 9/18 52/665
3,835,614 A * 9/1974 Downing, Jr. ..... E04B 9/16 52/666
3,848,385 A * 11/1974 Thompson ..... E04B 9/14 52/506.06
3,916,773 A 11/1975 Dail
3,918,354 A 11/1975 Lambert
4,006,567 A * 2/1977 Flannery ..... E04B 9/00 52/64
4,351,863 A 10/1982 Oleszak
4,603,618 A * 8/1986 Soltis ..... F24F 3/161 454/187
5,141,473 A * 8/1992 Swaney ..... E04B 9/02 454/299
5,144,781 A 9/1992 Fitzner
5,207,035 A * 5/1993 Fowler ..... E04B 9/00 52/14
5,312,296 A 5/1994 Aalto et al.
5,363,908 A 11/1994 Koster
5,513,953 A 5/1996 Hansen
5,657,744 A 8/1997 Vianen
6,202,361 B1 * 3/2001 Thorp ..... A47B 5/00 108/149
6,467,228 B1 * 10/2002 Wendt ..... E04B 9/003 52/145
7,651,390 B1 1/2010 Profeta et al.
7,886,496 B1 * 2/2011 Spransy ..... E04B 9/183 52/506.06
8,046,966 B2 * 11/2011 Moore ..... E04B 9/30 52/506.06
8,596,008 B2 * 12/2013 Waters ..... E04B 9/18 52/506.06
2008/0259616 A1 * 10/2008 Morgan ..... E04B 9/0464 362/404
2010/0229475 A1 * 9/2010 Myers ..... E04B 9/10 52/173.1
2010/0287861 A1 * 11/2010 Goldberg ..... E04B 2/707 52/302.1
2010/0287863 A1 * 11/2010 Goldberg ..... E04B 1/70 52/302.1
2014/0318733 A1 * 10/2014 Bagwell ..... F24F 13/14 165/11.1
2015/0068135 A1 * 3/2015 Waters ..... E04B 9/366 52/39
2018/0283004 A1 * 10/2018 Gillette ..... E04B 9/366

FOREIGN PATENT DOCUMENTS

EP 0966636 B1 3/2005
EP 1586823 A2 10/2005
EP 1596137 A2 11/2005
EP 1772568 A1 4/2007
GB 2407590 B 3/2007
WO WO 02/40926 A1 5/2002
WO WO 2006/042991 A1 4/2006

* cited by examiner

CEILING SYSTEM WITH AIR MOVEMENT

CROSS-REFERENCE TO RELATED APPLICATIONS

This application is a National Stage of International Application No. PCT/US17/51571, filed on Sep. 14, 2017, which claims the benefit of U.S. Provisional Application No. 62/395,035, filed on Sep. 15, 2016. The disclosure of the above application is incorporated herein by reference.

FIELD

The present invention relates to building ceiling systems. Particular embodiments of the invention relate to an air moving system used with a suspended acoustical ceiling system.

BACKGROUND

Many types of ceiling systems include panels, such as, for example, acoustical panels that are suspended from a building structure and separate a building space into an occupied space below the ceiling system and a plenum space above the ceiling system.

Such suspended ceiling systems can present challenges and with regard to heating, ventilation, and air conditioning of the occupied space. Some suspended ceiling systems include grills, registers and diffusers or other openings that allow conditioned air from an HVAC (heating, ventilating, and air conditioning) system to enter the occupied space.

Various systems and methods for improving thermal comfort in an occupied space exist.

These include using a passive thermal mass such as stone, concrete, brick, or water to passively store and released thermal energy to the thermal benefit of the occupants of the occupied space.

Another way to improve thermal comfort is to use fans to produce the desired airflow across occupants of the occupied space ("adaptive comfort"). Thermally comfortable conditions can be achieved in even very hot environments when air flow is introduced over people's bodies. A significant energy saving benefit can be recognized when an adaptive comfort strategy is used to create desired thermal conditions in the building. With an adaptive comfort strategy, air temperatures can be allowed to increase well above "normal" set point temperatures. For example, set point temperatures may be increased from 75° F. up to 82° F. Typically, this would create a very uncomfortable thermal environment in a building. However, when local air flow is introduced these conditions are perceived as quite pleasant by many occupants. Another very significant benefit to this adaptive comfort strategy is that for each 1° F. increase in set point temperature that is permitted in a building, a resulting energy savings of from 3% to 5% can be realized. Allowing the set point temperature to increase 7° F. (from 75° F. to 82° F.) can produce an energy savings of between 21% and 35%.

Yet another way to improve thermal comfort is the use of radiant heating and cooling systems. Modern, ceiling-based radiant heating and cooling panels offer significant energy savings to the user but are essentially capacity-limited by the rate of radiant heat transfer between the panel and the occupants of the space.

SUMMARY

Certain problems exist with each of the three methods for improving thermal comfort described above.

Fans can be added to passive thermal mass systems. However, the acoustical issues with the hard surfaces typically used for these systems would remain. Embodiments of the invention introduce acoustic absorption while simultaneously increasing the thermal performance of the thermally massive material.

Bladed fans, bladeless fans, or "punkah" style fans can be used to create air motion in adaptive comfort strategies. However, these fans are typically very intrusive and very noticeable in the space. In some cases, such as a classroom for children, moving blades might be undesirable as they can be distracting. Embodiments of the invention have no moving parts in the occupied space. The air mover is integrated in the design of the ceiling panel and is essentially hidden from view. Embodiments of the invention use an induction style venturi to induce air motion. This is a very energy efficient way of moving large volumes of air. Embodiments of the invention can also introduce varying flow or oscillating flow rates to simulate a more natural breeze as experienced outdoors in nature.

Fans can be used as separate elements to existing radiant panels. However, adding such fans to an existing system would be inelegant. Embodiments of the invention integrate the air mover fully within the design of a ceiling panel. The ceiling panel is located up in the ceiling void in close proximity to the existing radiant panel system.

Particular embodiments of the invention provide a ceiling system that includes a ceiling structure suspended within a space of a building thereby dividing the space into an occupied space below the ceiling structure and a plenum space above the ceiling structure; a panel structure supported by the ceiling structure and having an opening; a pressurized air passageway aligned with the opening, the pressurized air passageway having an outlet; and an inductive air passageway adjacent the pressurized air passageway, the inductive air passageway having an inlet and an outlet. The pressurized air passageway and the inductive air passageway are configured such that pressurized air passing through the outlet of the pressurized air passageway induces an induced air flow out of the outlet of the inductive air passageway.

Some embodiments include the induced air flow being air from the plenum that flows through the inductive air passageway.

Some embodiments include the panel structure being an acoustical panel structure.

Some embodiments include the panel structure being a canopy-type panel structure that is configured such that the panel structure is spaced away from a wall of the occupied space.

Some embodiments include the outlet of the inductive air passageway directing the induced airflow toward the occupied space.

Some embodiments include the pressurized air and the induced air flow mixing together at the outlet of the pressurized air passageway.

Some embodiments include the pressurized air passageway being fluidly connected to an air supply space other than the plenum space and drawing the pressurized air from the air supply space.

Some embodiments include the pressurized air passageway being tubular.

Some embodiments include the pressurized air passageway including a venturi.

Some embodiments include the outlet of the pressurized air passageway being a slot.

Some embodiments include the inductive air passageway being formed by an air diverter located near an outside surface of the pressurized air passageway.

Some embodiments include the inductive air passageway comprising two inductive air passageways, each of the inductive air passageways being formed by an air diverter located near an outside surface of the pressurized air passageway.

Some embodiments include the pressurized air passageway being located between the air diverters.

Some embodiments include an air moving device that supplies pressurized air to the pressurized air passageway.

Some embodiments include the pressurized air passageway being ring shaped, and the outlet being a slot in the lower side of the ring shape.

Some embodiments include the pressurized air passageway and the inductive air passageway being located within a field area of the panel structure, the field area of the panel structure being an area away from all edges of the panel structure.

Some embodiments include the pressurized air passageway and the inductive air passageway being attached to an edge of the panel structure.

Some embodiments include a plurality of panel structures, wherein the pressurized air passageway and the inductive air passageway are attached to an edge of one of the plurality of panel structures, and the pressurized air passageway and the inductive air passageway are located between two adjacent ones of the plurality of panel structures.

Some embodiments include a phase change material attached to, or integral with, the panel structure.

Some embodiments include a water evaporation device, the water evaporation device being configured to present water to the pressurized air or the inductive air flow.

Particular embodiments of the invention provide a method of moving air in an occupied space in a building. The method includes dividing with a ceiling structure the space in the building into an occupied space below the ceiling structure and a plenum space above the ceiling structure; providing an opening in a panel structure supported by the ceiling structure; and inducing an induced airflow out of an outlet of an inductive air passageway by passing pressurized air though an outlet of a pressurized air passageway, the inductive air passageway being adjacent the pressurized air passageway, and the pressurized air passageway being aligned with the opening in the panel structure. The pressurized air passageway and the inductive air passageway are configured such that pressurized air passing through the outlet of the pressurized air passageway induces an induced air flow out of the outlet of the inductive air passageway.

Some methods of the invention include the induced air flow being air from the plenum that flows through the inductive air passageway.

Some methods of the invention include the panel structure being an acoustical panel structure.

Some methods of the invention include the panel structure being a canopy-type panel structure that is configured such that the panel structure is spaced away from a wall of the occupied space.

Some methods of the invention include the induced airflow being directed toward the occupied space by the outlet of the inductive air passageway.

Some methods of the invention include the pressurized air and the induced air flow being mixed together at the outlet of the pressurized air passageway.

Some methods of the invention include the pressurized air passageway being fluidly connected to an air supply space other than the plenum space and the pressurized air being drawn from the air supply space.

Some methods of the invention include the pressurized air passageway being tubular.

Some methods of the invention include the feature of the pressurized air passageway including a venturi.

Some methods of the invention include the outlet of the pressurized air passageway being a slot.

Some methods of the invention include the inductive air passageway being formed by an air diverter located near an outside surface of the pressurized air passageway.

Some methods of the invention include the inductive air passageway comprising two inductive air passageways, each of the inductive air passageways being formed by an air diverter located near an outside surface of the pressurized air passageway.

Some methods of the invention include the pressurized air passageway being located between the air diverters.

Some methods of the invention include supplying pressurized air to the pressurized air passageway with an air moving device.

Some methods of the invention include the pressurized air passageway being ring shaped, and the outlet being a slot in the lower side of the ring shape.

Some methods of the invention include the pressurized air passageway and the inductive air passageway being located within a field area of the panel structure, the field area of the panel structure being an area away from all edges of the panel structure.

Some methods of the invention include the pressurized air passageway and the inductive air passageway being attached to an edge of the panel structure.

Some methods of the invention include locating the pressurized air passageway and the inductive air passageway between two adjacent ones of a plurality of panel structures, wherein the pressurized air passageway and the inductive air passageway are attached to an edge of one of the plurality of panel structures.

Some methods of the invention include a phase change material attached to, or integral with, the panel structure.

Some methods of the invention include presenting water to the pressurized air or the inductive air flow with a water evaporation device.

Particular embodiments of the invention provide a ceiling system including a ceiling structure suspended within a space of a building thereby dividing the space into an occupied space below the ceiling structure and a plenum space above the ceiling structure; a first panel structure supported by the ceiling structure and having an edge; a pressurized air passageway attached to the edge of the first panel structure, the pressurized air passageway having an outlet; and an inductive air passageway adjacent the pressurized air passageway, the inductive air passageway being attached to the edge of the first panel structure and having an inlet and an outlet. The pressurized air passageway and the inductive air passageway are configured such that pressurized air passing through the outlet of the pressurized air passageway induces an induced air flow out of the outlet of the inductive air passageway.

Some embodiments include the first panel structure being oriented in a baffle-style arrangement such that the edge of the first panel structure is a lowest edge of the first panel structure, and the inductive air passageway is located below the edge of the first panel structure.

Some embodiments include a second panel structure supported by the ceiling structure.

Some embodiments include the second panel structure having a lower edge, the first panel structure and the second panel structure being oriented in a baffle-style arrangement, and the first panel structure and the second panel structure being attached to each other such that the inductive air passageway is attached to and is located below the lower edge of the first panel structure and the lower edge of the second panel structure.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
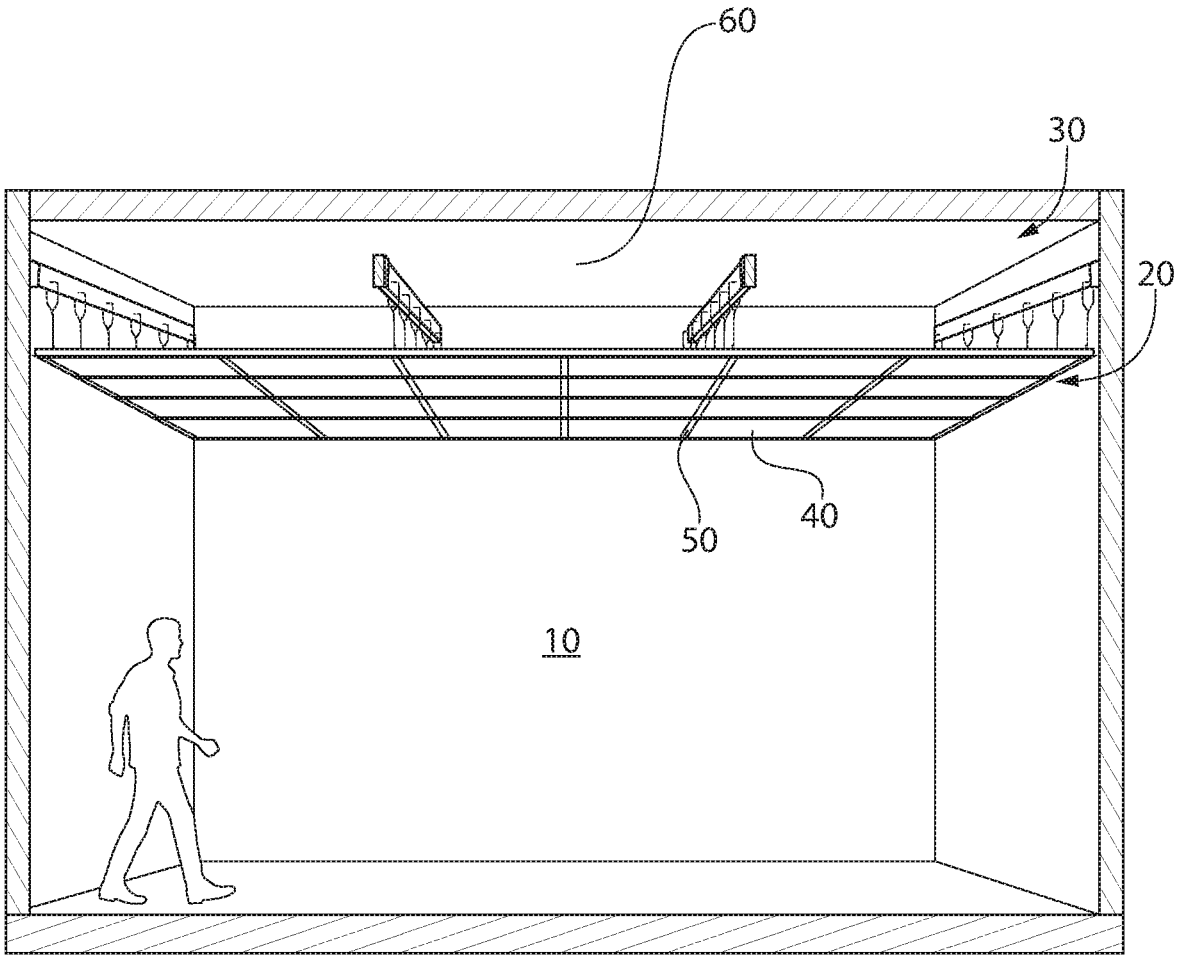
FIG. 1 is a sectional view of an occupied space, ceiling system, and plenum space.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The following description of the preferred embodiments is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

The term "opening" as used in this application can refer to any passageway through which air can travel.

As explained above, occupant comfort and operating efficiency can be improved by implementing systems and methods according to embodiments of the invention. Particular embodiments use inductive airflow incorporated into a ceiling panel to achieve these benefits.

Many types of ceiling systems and methods for mounting ceiling panels have been used. One type of system uses a suspended metal support grid including an array of orthogonally intersecting grid support members. An array of grid openings are formed between the grid support members. These openings are filled by the ceiling panels. Ceiling panels are mounted to and supported by the support grid using numerous approaches. Other types of ceiling systems can use ceiling panels, such as plank ceiling systems, canopy type ceiling systems and baffle type ceiling systems.

A building panel can be part of a building system such as a ceiling or wall. In particular embodiments, the building panel is part of a ceiling system which separates an occupied space from a plenum space. The occupied space is space below the ceiling system such as office space or the like. The plenum space is space above the ceiling system in which mechanical, electrical and other building systems and equipment can be housed. In some situations, the plenum space is simply an open space above the ceiling system and below the upper structure of the building space.

FIG. 1 shows an example of one type of suspended ceiling system. In this example, an occupied space 10 such as, for example, office space is shown below a ceiling system 20 that extends to and contacts all four walls of the office space. Above ceiling system 20 and below structural slab 60 is a plenum space 30 that can house building systems such as ductwork, wiring, water piping and fire sprinkler piping. Ceiling system 20 includes a plurality of panels 40 supported by a suspended grid structure 50. Other types of suspended ceiling systems will be described below.

Figure 2:
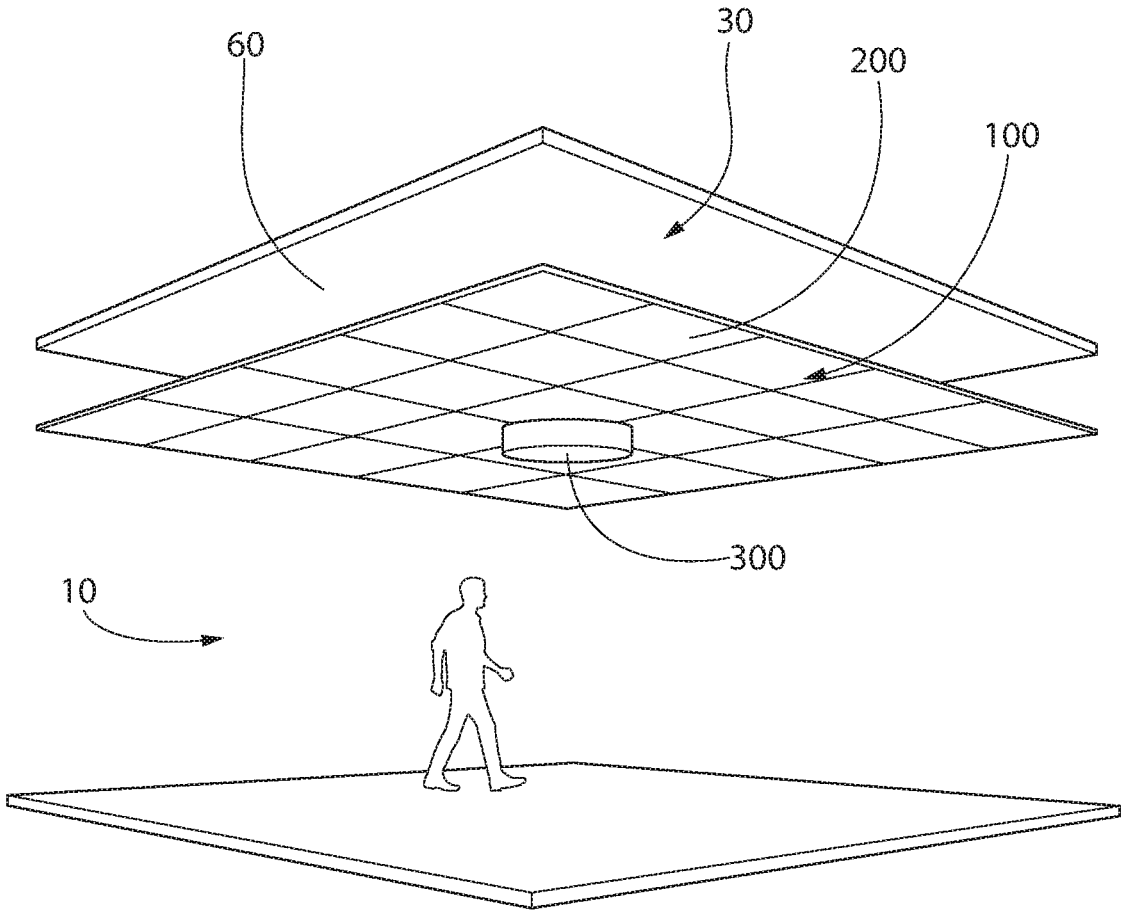
FIG. 2 is a perspective view of a ceiling system having an air mover hanging below a suspended ceiling.
Figure 7:
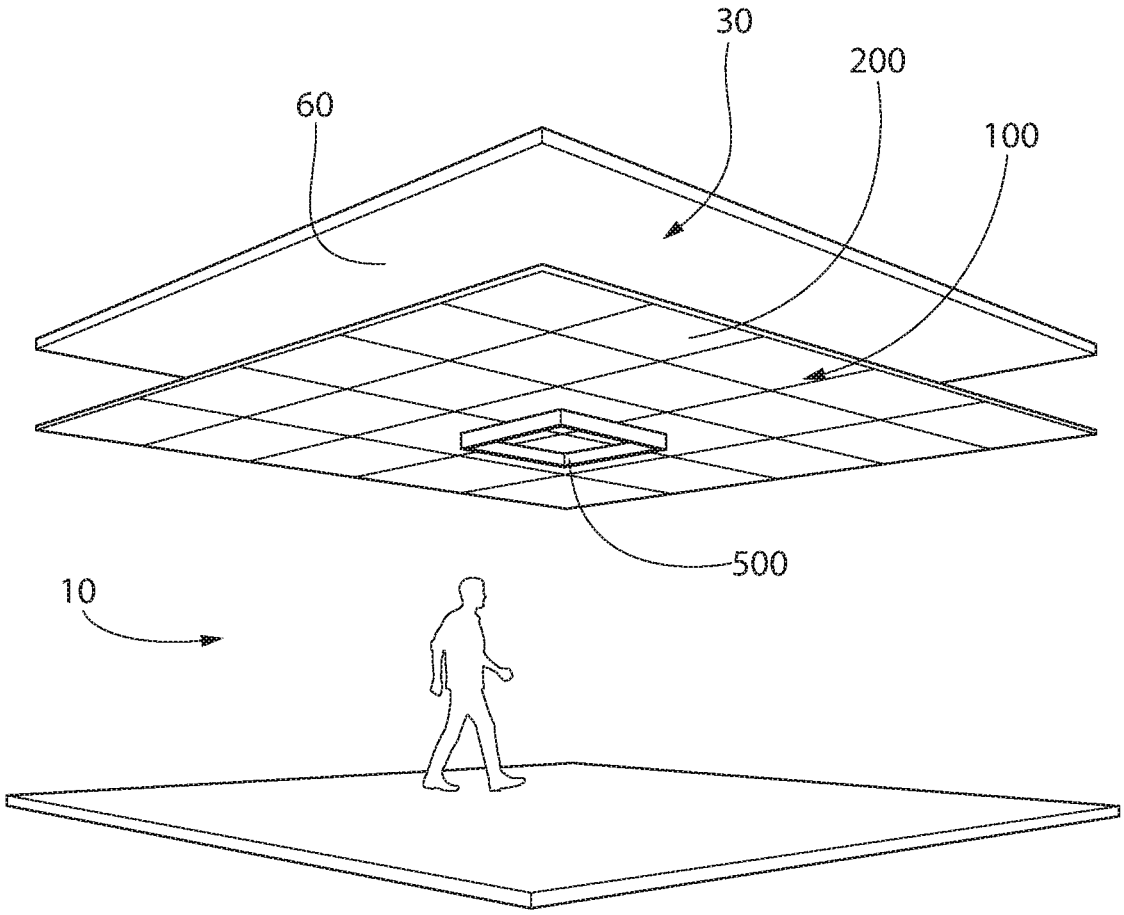
FIG. 7 is a perspective view of a ceiling system having a rectangular air mover.

FIG. 2 shows an example of a ceiling system 100 that separates a building space into an occupied space 10 and a plenum space 30. Plenum space 30 is above ceiling system 100 and below structural slab 60. Ceiling system 100 has a plurality of ceiling panels 200 that, in this example, are acoustic ceiling panels. An air moving system 300 is shown in this example as integrated into a group of four ceiling panels 200. In other examples, such as the example shown in FIGS. 3 and 4, air moving system 300 is integrated into a single ceiling panel 200. While the example shown in FIG. 2 is a round air moving system, other shapes can also be used. For example, FIG. 7 shows an example of a square air moving system 500. In FIG. 7, air moving system 500 is shown as integrated into a group of four ceiling panels 200. In other examples, air moving system 500 is integrated into a single ceiling panel 200.

Figure 3:
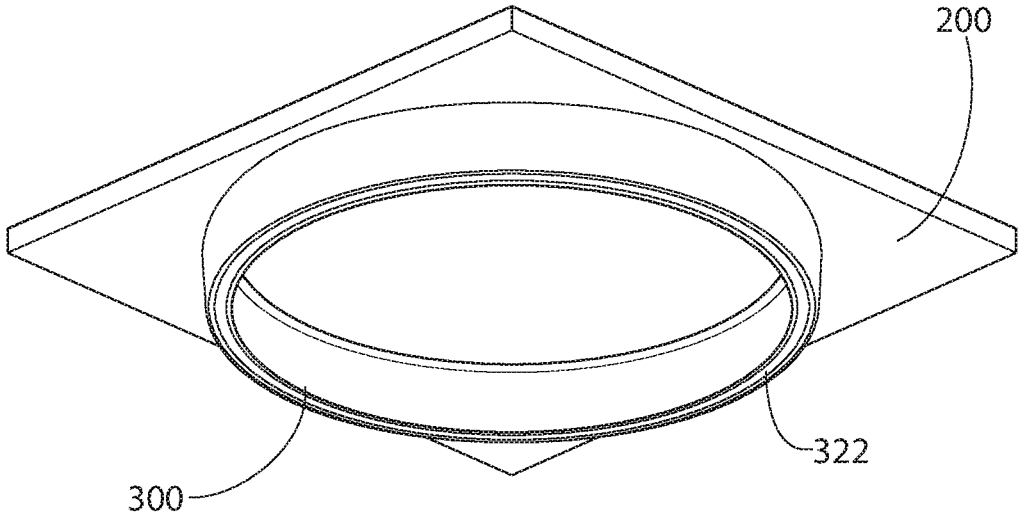
FIG. 3 is a perspective view of an example of a ceiling panel in accordance with the embodiment shown in FIG. 2.
Figure 4:
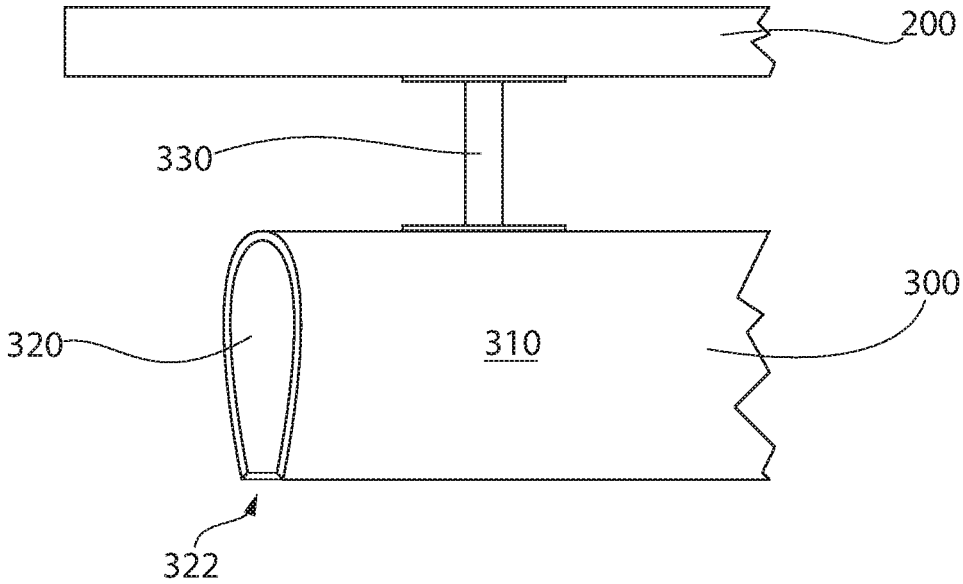
FIG. 4 is a partial sectional view of an example of a ceiling panel in accordance with the embodiment shown in FIG. 2.

As shown in FIGS. 3 and 4, air moving system 300 has a body 310 that defines a pressurized air passageway 320. Pressurized air exits pressurized air passageway 320 through an opening 322 along the bottom of body 310. In FIG. 3, body 310 is mounted directly to ceiling panel 200, whereas in FIG. 4, body 310 is mounted to ceiling panel 200 by way of one or more supports 330. Supports 330 can be hollow to provide a conduit for the pressurized air from an air source above ceiling panel 200 to pressurized air passageway 320. The air source can be a fan located in plenum space 30 or a remotely located fan that pushes air through ductwork that is located in plenum space 30.

Figure 5:
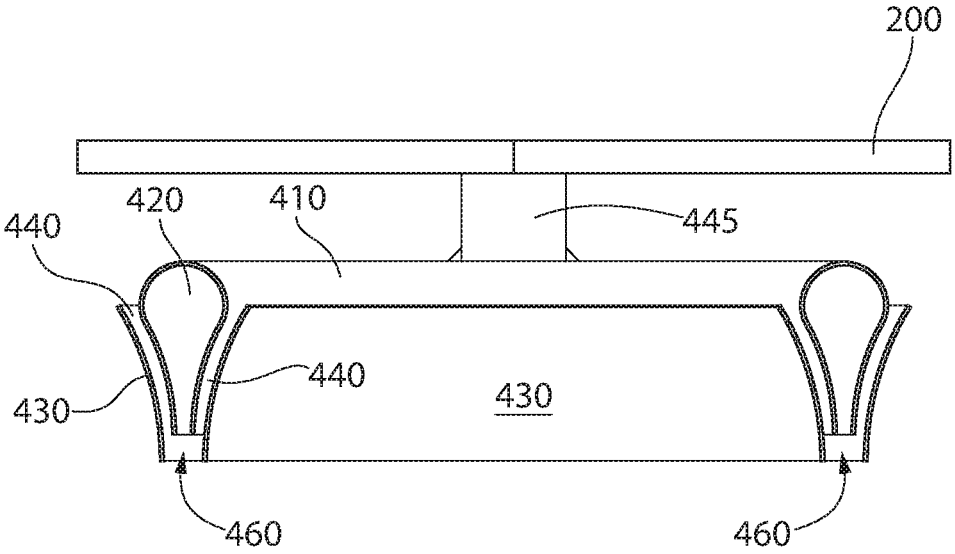
FIG. 5 is a partial sectional view of an annular induction air mover.
Figure 6:
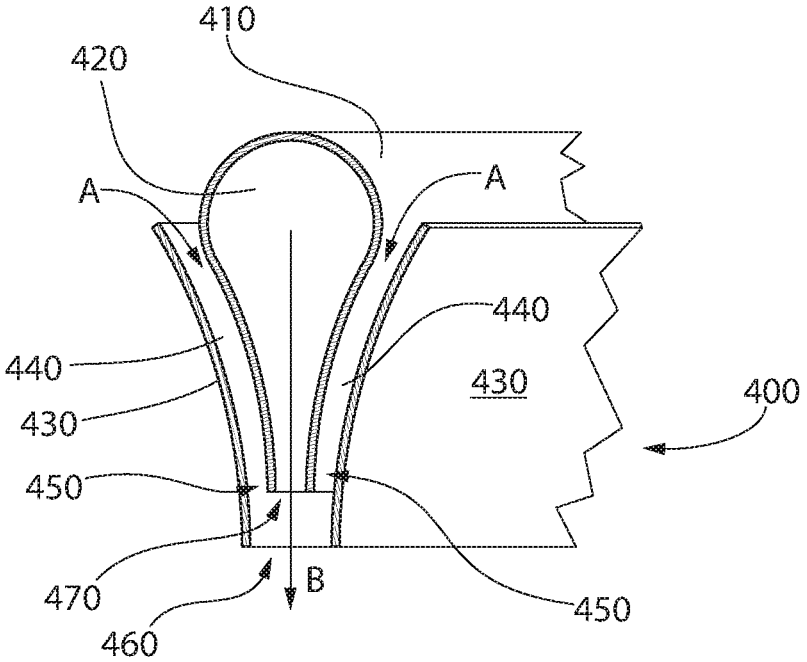
FIG. 6 is a partial sectional view of the annular induction air mover of FIG. 5.

FIGS. 5 and 6 show an example of an embodiment of the invention that induces airflow by the use of a venturi. In such embodiments, pressurized air is fed into a venturi to increase the air flow velocity and then exhausted adjacent to one or more inductive air passageways such that the exhausted pressurized air induces air flow through the inductive air passageways. An air moving system 400 has a pressurized air passageway 420 inside a body 410. Pressurized air passageway 420 is fed pressurized air from a remote fan or other air mover that can be located in the plenum space, or located outside of the plenum space and pushes air through ductwork that is located in the plenum space. In this example, the pressurized air can be routed through one or more supports 445. In this example, two air diverters 430 are positioned adjacent to body 410 to create inductive air passageways 440. Other examples can have one or more than two inductive air passageways. As the pressurized air flows out of an outlet 470 of pressurized air passageway 420 (represented by arrow B), low pressure regions are created at outlets 450 of inductive air passageways 440. These low pressure regions result in air being drawn (represented by arrows A) into inductive air passageways 440 and expelled from outlet 460. The pressurized air flowing from outlet 470 and the induced airflow from outlets 450 mixes and is distributed into the occupied space. Such an induced airflow system can provide increased airflow economically and less obtrusively than a conventional fan. In addition, when the induced airflow is drawn from the occupied space, as in this example, increased circulation is achieved with a reduced fan requirement. This increased circulation provides additional efficiency by mixing the pressurized air, which may be heated or cooled, with the air that is in the occupied space.

Figure 8:
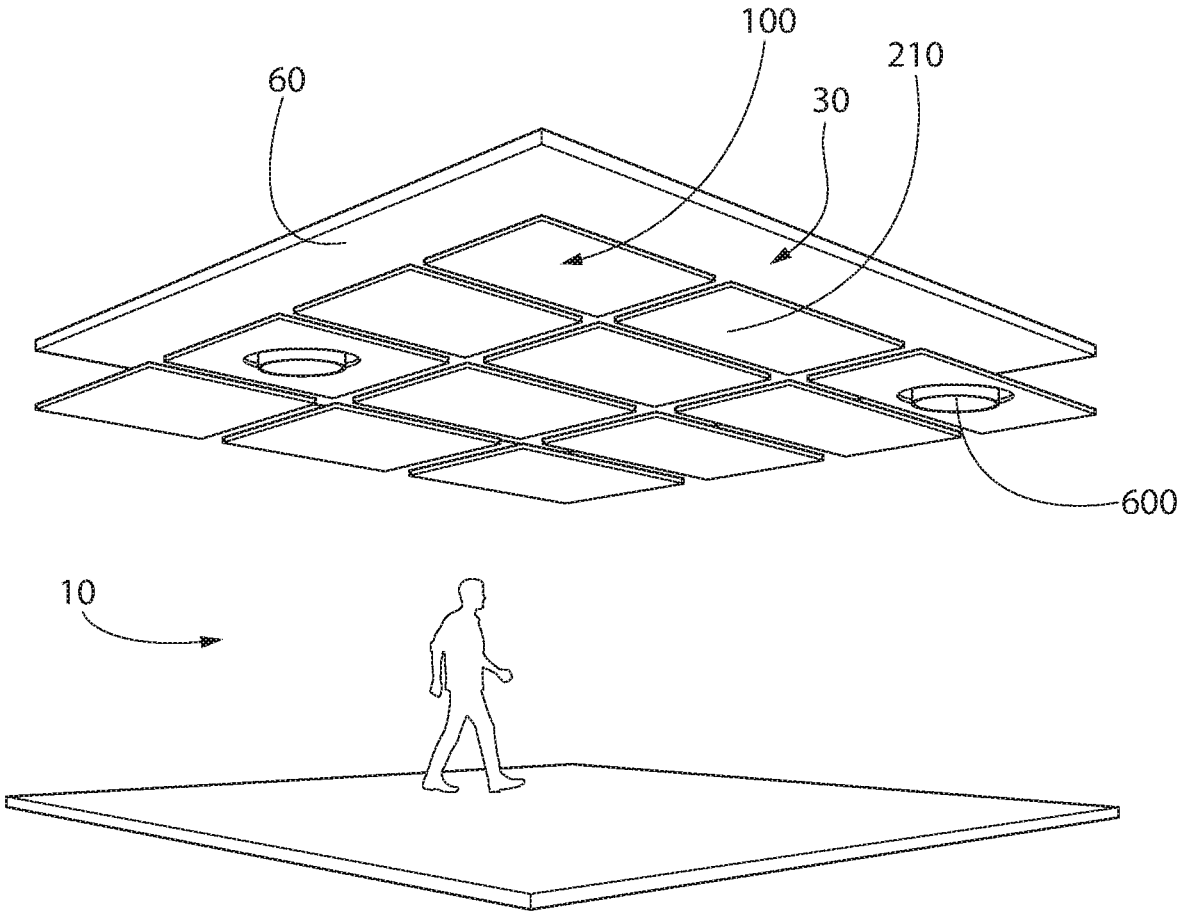
FIG. 8 is a perspective view of a canopy ceiling system in which an air mover is an integral part of the ceiling system.
Figure 9:
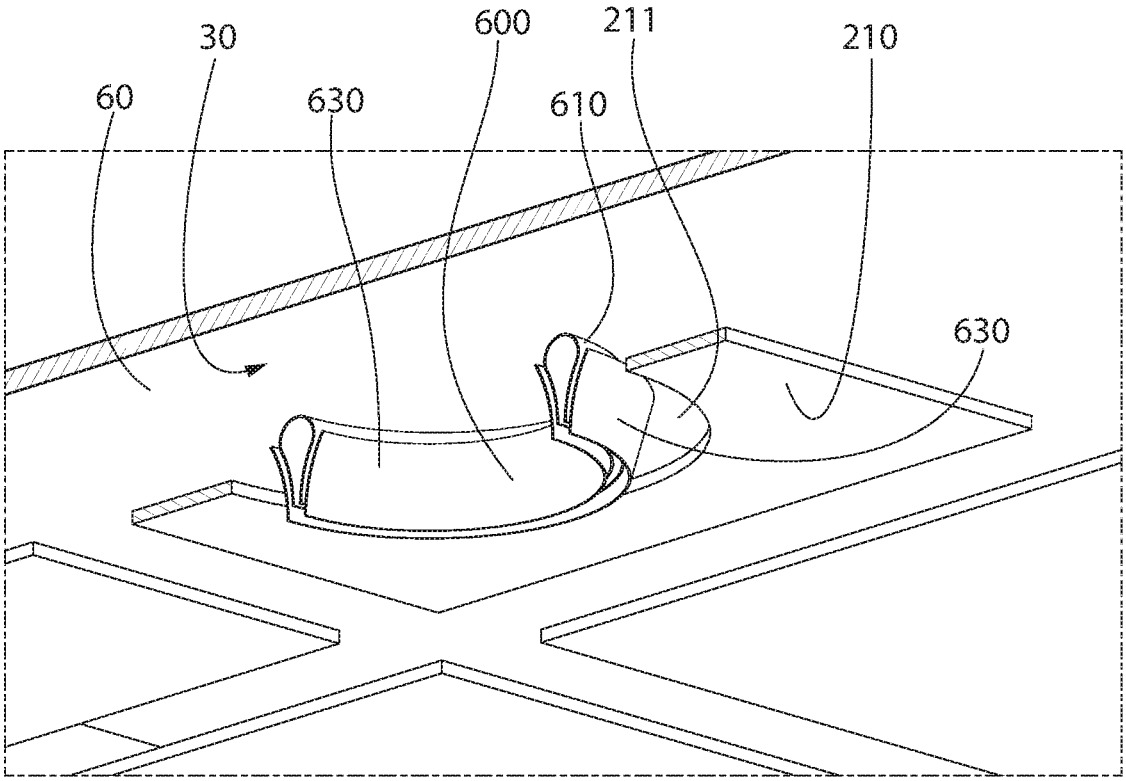
FIG. 9 is a partial sectional view of the canopy ceiling system of FIG. 8.

Other examples of the invention draw the induced airflow from an area outside of the occupied space, such as, for example, the plenum space. FIGS. 8 and 9 show such an example. In FIG. 8, a canopy type ceiling system 100 is shown. In such a canopy type ceiling system, one or more ceiling panels 210 are suspended in a building space to divide the building space into an occupied space 10 and a plenum space 30. Plenum space 30 is located between ceiling system 100 and structural slab 60. Canopy type ceiling systems usually do not extend all the way to the walls of the occupied space, but instead are positioned away from the walls so as to create gaps. Similarly, ceiling panels 210 in a canopy type ceiling system are usually spaced apart such that they do not contact each other. However, in some canopy type ceiling systems, multiple panels can contact each other to form one or more canopies.

Evaporative cooling can be included in any of the embodiments of the invention. An example of such evaporative cooling includes introducing water into the pressurized air passageway or the inductive air passageway. This can be done by, for example, wetting a surface (such as a porous surface or a wick) in one of the passageways or spraying water into one of the air streams.

In the system shown in FIGS. 8 and 9, an air moving system 600 is located in an opening 211 in ceiling panel 210. Similar to the system shown in FIGS. 5 and 6, air moving system 600 has a pressurized air passageway inside a body 610. The pressurized air passageway is fed pressurized air from a remote fan or other air mover that can be located in plenum space 30, or located outside of plenum space 30 and pushes air through ductwork that is located in plenum space 30. In this example, the pressurized air can be routed through one or more supports (not shown). In this example, two air diverters 630 are positioned adjacent to body 610 to create an inductive air passageway on either side of body 610. Other examples can have one or more than two inductive air passageways. As the pressurized air flows out of the outlet at the bottom of the pressurized air passageway, low pressure regions are created at the outlets of the inductive air passageways. These low pressure regions result in air being drawn into the inductive air passageways and expelled from outlet of body 610. The pressurized air flowing from the outlet of body 610 and the induced airflow from the outlets of the inductive air passageways mixes and is distributed into the occupied space. In this example, the induced airflow is drawn from plenum space 30. This arrangement draws the air that can stagnate above a canopy type (or other type) ceiling and circulates it into the occupied space.

In some embodiments of the invention, the ceiling panel is an acoustic panel. The acoustic panel can be made from a range of fibers, porous materials including mineral fiber, wood wool, fiberglass, rock wool, sintered metals, foamed polymeric materials, and perforated metals, for example.

Figure 11:
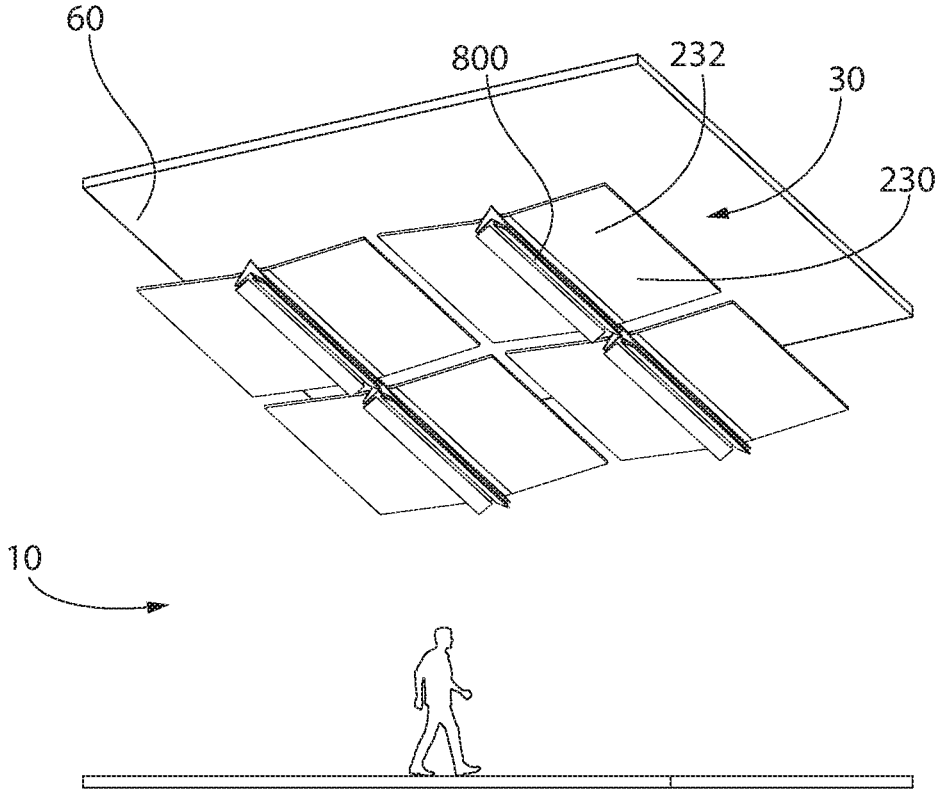
FIG. 11 is a perspective view of an angled canopy ceiling system in which an air mover is an integral part of the ceiling system.
Figure 12:
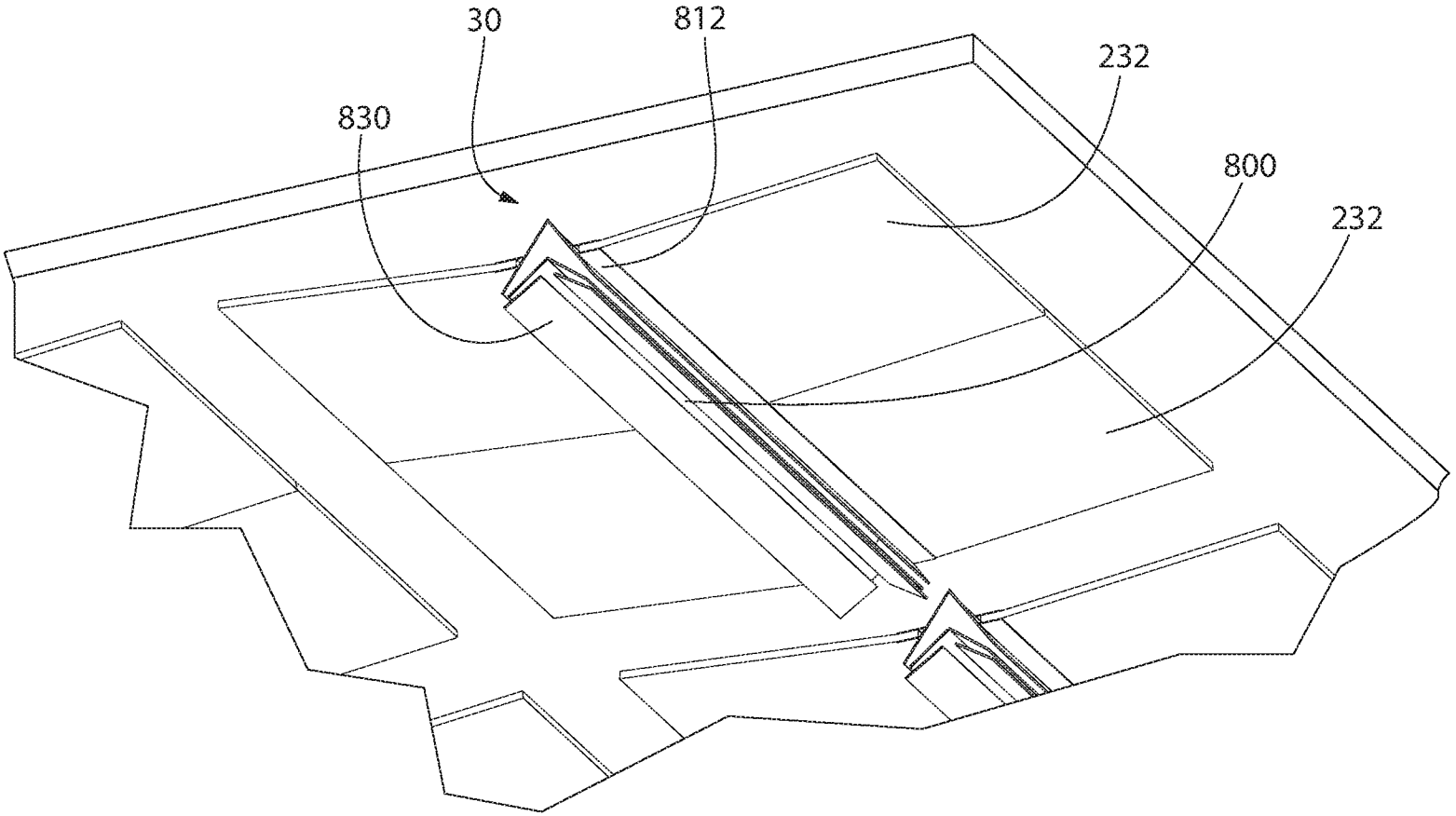
FIG. 12 is an enlarged view of the ceiling system of FIG. 11.
Figure 13:
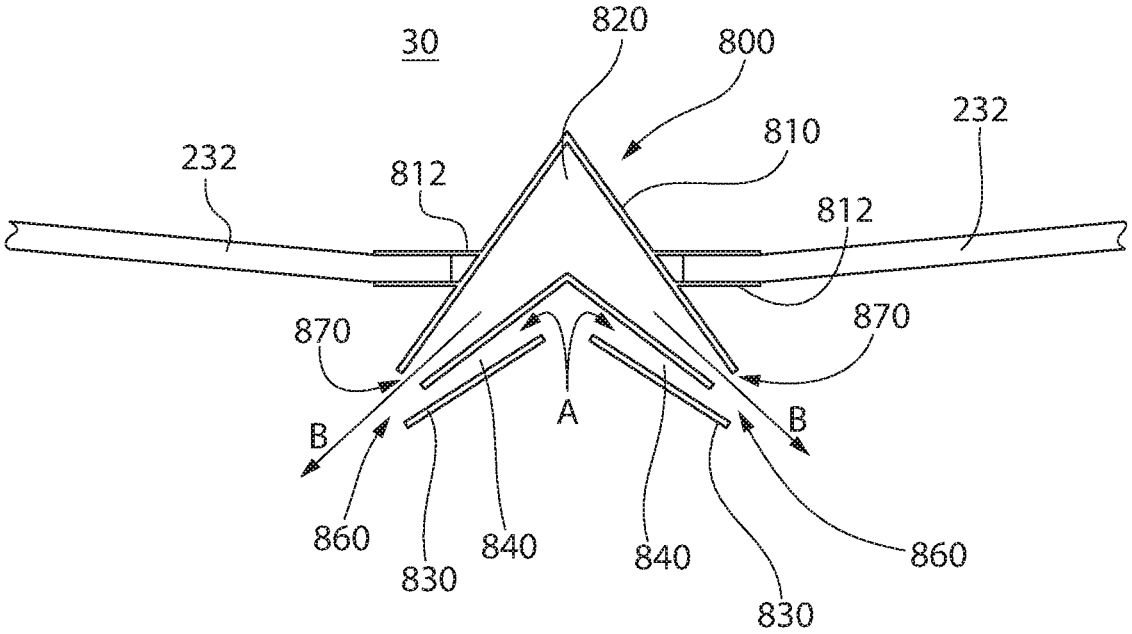
FIG. 13 is a sectional view of the ceiling system of FIGS. 11 and 12.

While the air diverters in the examples shown above are curved, linear air diverters can also be used (as seen in the example shown in FIGS. 11-13). The air diverters and the body of the air moving system can be made, for example, from metal or polymeric materials.

As stated above, the fan or other air mover can be mounted on the ceiling panel or can be remotely located. Locating the fan and motor remotely from the occupied space and/or the plenum space has the advantages of removing a source of heat and noise from the occupied space. Also, a single (or multiple) remotely located fan can provide pressurized air to multiple air moving systems.

Another form of suspended ceiling that can be improved by embodiments of the invention is the baffle type ceiling.

Figure 10:
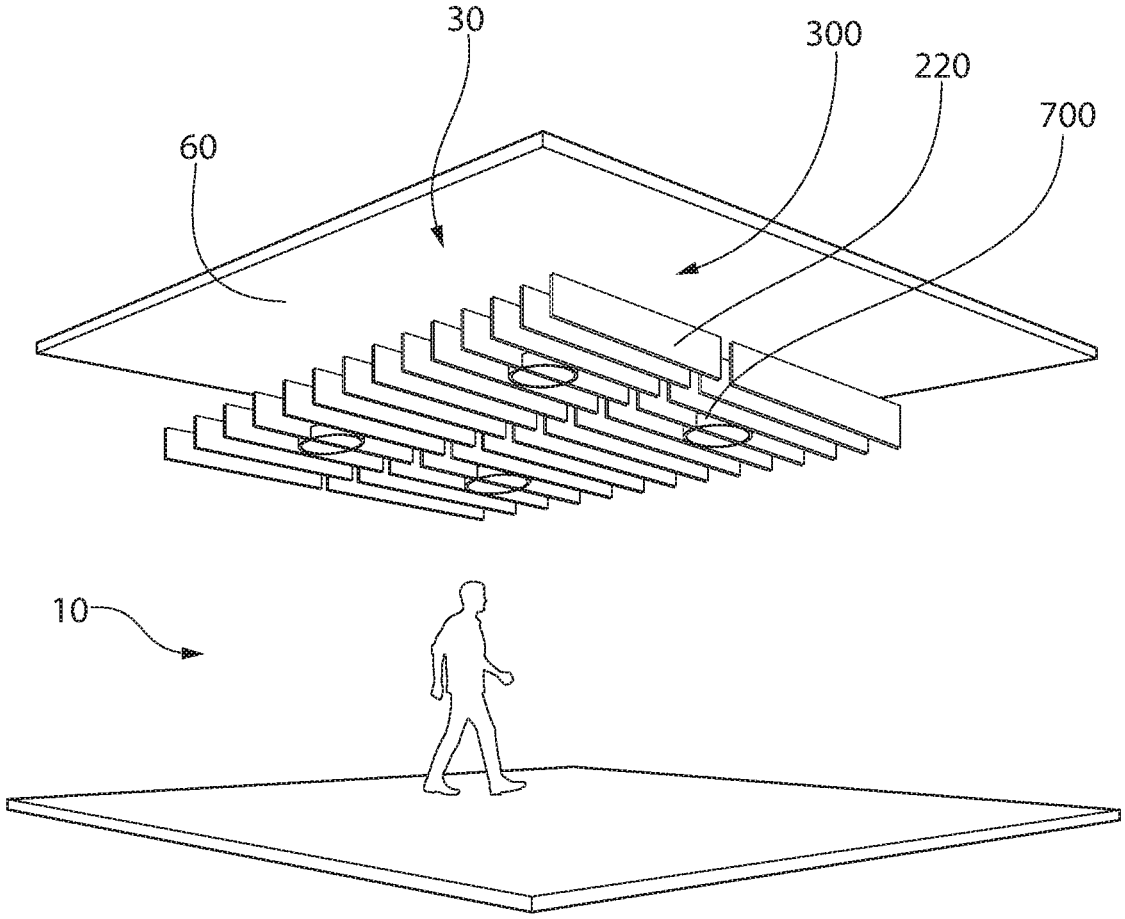
FIG. 10 is a perspective view of a baffle type ceiling system in which an air mover is an integral part of the ceiling system.

FIG. 10 shows a baffle type ceiling system 300 having a plurality of vertically oriented baffles 220 that separate a building space into an occupied space 10 and a plenum space 30. Plenum space 30 is located between baffles 220 and a structural slab 60. An air moving system 700 is incorporated into particular ones of baffles 220 to create an unobtrusive and efficient air moving system. Air moving system 700 can be similar to air moving system 600 shown in FIG. 9, but split into two semi-circles that are attached to either side of one of the baffles 220. While a semi-circular shape is shown in the figures, other shapes such as, for example, diamond, square, rectangular, triangle, oval, compound curve, or other shape can also be used. The pressurized air can be fed to air moving system 700 by way of a conduit that runs inside baffle 220 and is therefore hidden from view, or it can be fed by way of a conduit that is a separate support for air moving system 700. The fan or air mover that supplies the pressurized air to air moving system 700 can be located inside baffle 220, on top of baffle 220, in the plenum space, or remotely from the building space.

FIGS. 11-13 show an example of another type of ceiling system that can be improved by embodiments of the invention. FIG. 11 shows a canopy type ceiling system that has panels 230 extending in the shape of wings from a central spine. Panels 230 separate a building space into an occupied space 10 and a plenum space 30. Plenum space 30 is located between panels 230 and a structural slab 60. This system has an air moving system 800 that acts as the spine to which panels 230 are attached. Some embodiments have only one panel 230 extending from each side of the spine, whereas other embodiments have multiple panels 232 extending from each side.

FIGS. 12 and 13 show air moving system 800 in more detail. Similarly to the other examples discussed, air moving system 800 has a pressurized air passageway 820 inside a body 810. Pressurized air passageway 820 is fed pressurized air from a remote fan or other air mover that can be located in the plenum space, or located outside of the plenum space and pushes air through ductwork that is located in the plenum space. In this example, the pressurized air can be routed through one or more supports (not shown). In this example, two air diverters 830 are positioned adjacent to body 810 to create inductive air passageways 840. Other examples can have one or more than two inductive air passageways. As the pressurized air flows out of outlets 870 of pressurized air passageway 820 (represented by arrows B), low pressure regions are created at outlets of inductive air passageways 840. These low pressure regions result in air being drawn (represented by arrows A) into inductive air passageways 840 and expelled from outlets 860. The pressurized air flowing from outlets 870 and the induced airflow from the inductive air passageway outlets mixes and is distributed into the occupied space. Such an induced airflow system can provide increased airflow economically and less obtrusively than a conventional fan. In addition, when the induced airflow is drawn from the occupied space, as in this example, increased circulation is achieved with a reduced fan requirement. This increased circulation provides additional efficiency by mixing the pressurized air, which may be heated or cooled, with the air that is in the occupied space.

In this example, air moving system 800 acts as the structural support for panels 232. As shown in FIG. 13, body 810 includes brackets 812 to which panels 232 are attached. Other connection methods and shapes can also be used.

Figure 14:
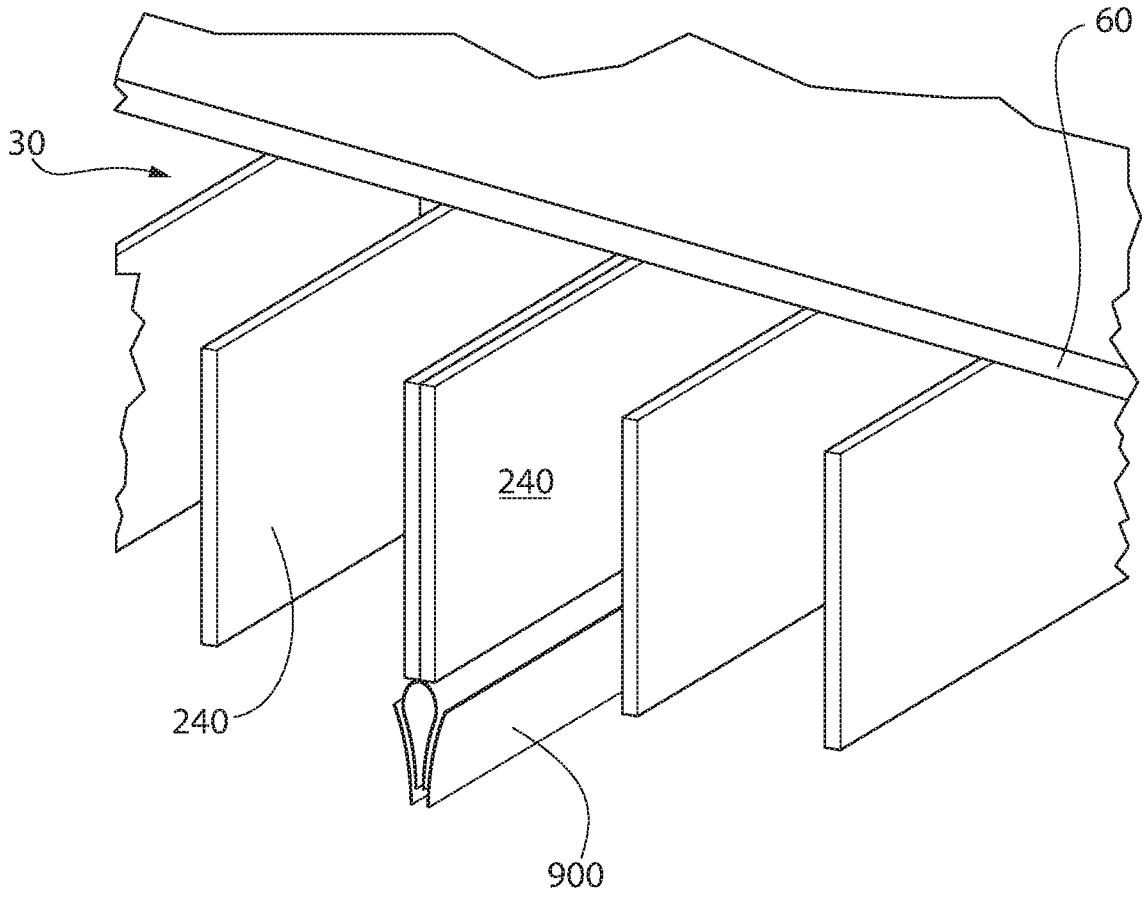
FIG. 14 is a partial sectional view of a baffle type ceiling system in which an air mover is an integral part of the ceiling system.

FIG. 14 shows an example of another type of ceiling system that can be improved by embodiments of the invention. FIG. 14 shows a baffle type ceiling system (similar to that shown in FIG. 10) that has a plurality of panels 240 extending vertically. Panels 240 separate a building space into an occupied space and a plenum space 30. Plenum space 30 is located between panels 240 and a structural slab 60. In this example, an air moving system 900 is attached to a bottom edge of one or more panels 240. Similarly to the other examples discussed, air moving system 900 has a pressurized air passageway inside a body. The pressurized air passageway is fed pressurized air from a remote fan or other air mover that can be located in the plenum space, or located outside of the plenum space and pushes air through ductwork that is located in the plenum space. In this example, the pressurized air can be routed through one or more supports (not shown). In this example, two air diverters are positioned adjacent to the body to create inductive air passageways. Other examples can have one or more than two inductive air passageways. As the pressurized air flows out of outlets of the pressurized air passageway, low pressure regions are created at outlets of the inductive air passageways. These low pressure regions result in air being drawn into the inductive air passageways and expelled from outlets of the inductive air passageways. The pressurized air flowing from the outlet of the pressurized air passageway and the induced airflow from the inductive air passageway outlets mixes and is distributed into the occupied space. Such an induced airflow system can provide increased airflow economically and less obtrusively than a conventional fan.

In this example, the induced airflow will tend to be drawn from the space between baffles 240. Although, some air induced air flow may be drawn from the occupied space. The composition of the induced airflow depends on the relative temperatures of the occupied space and the plenum space, the velocity of the air exiting air moving system 900, and the shape and size of the air diverters. The pressurized air can be fed to the pressurized air passageway by way of a conduit running in a baffle 240 or a conduit running between two baffles 240 that are attached to each other (as shown in FIG. 14). The number of air moving systems 900 used in a particular occupied space can be one or more. An air moving system 900 can be attached to every baffle, or can be attached to only certain baffles. Air moving system 900 can extend completely below the baffle, as shown in FIG. 14, or the baffle to which air moving system 900 is attached can be shortened so that the bottom of air moving system 900 is even with the bottoms of the baffles that do not have an air moving system. The position of air moving system 900 relative to the bottom of adjacent baffles will also influence from where the induced airflow will be drawn. All other things being equal, the more elevated the bottom of air moving system 900 is relative to the bottom of adjacent baffles, the more the induced air will be drawn from the plenum space.

Figure 15:
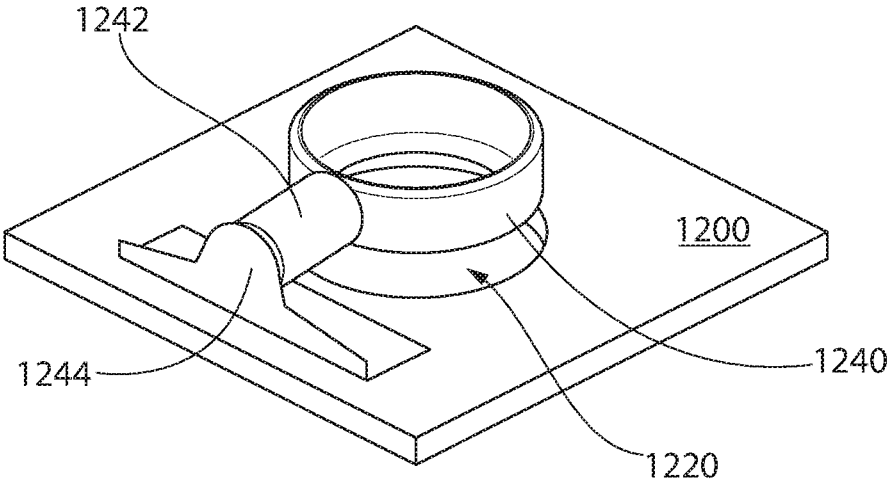
FIG. 15 is a perspective view of an oscillating induction air mover mounted to a ceiling panel.
Figure 16:
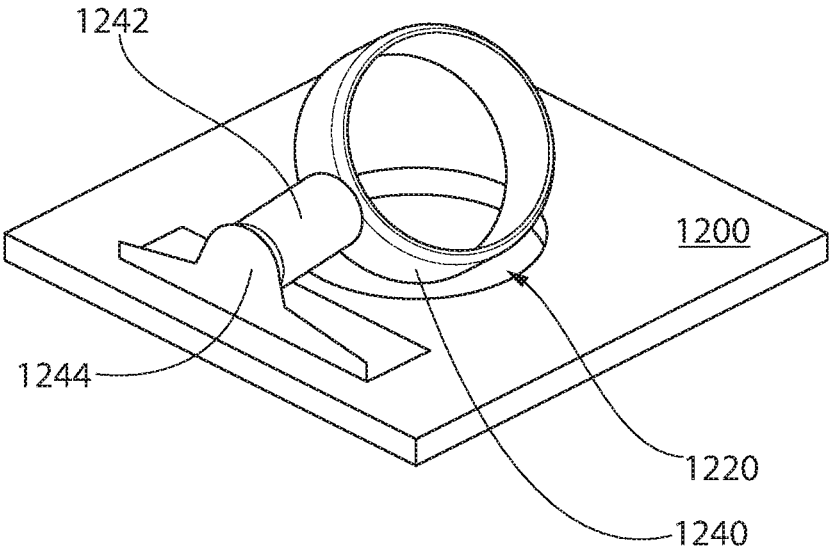
FIG. 16 is a perspective view of the ceiling panel of FIG. 15.

FIGS. 15 and 16 show an example of an air moving system 1200 that has an optionally oscillating induction fan 1240 mounted to a ceiling panel. Induction fan 1240 has a motor 1242 and is attached to the ceiling panel by way of a mount 1244. In particular embodiments, mount 1244 and/or motor 1242 cause induction fan 1240 to oscillate so that the air moved by air moving system 1200 passes though opening 1220 in the ceiling panel at different angles and therefore creates a simulation of a natural breeze on the occupants below. This arrangement draws an inductive airflow from the space above the ceiling panel (the plenum space) and mixes it with pressurized air. The pressurized air can be drawn from the plenum space or from a space outside of the plenum space. The pressurized air can be heated or cooled.

The benefits discussed above from using induced airflow also apply to this embodiment.

Figure 17:
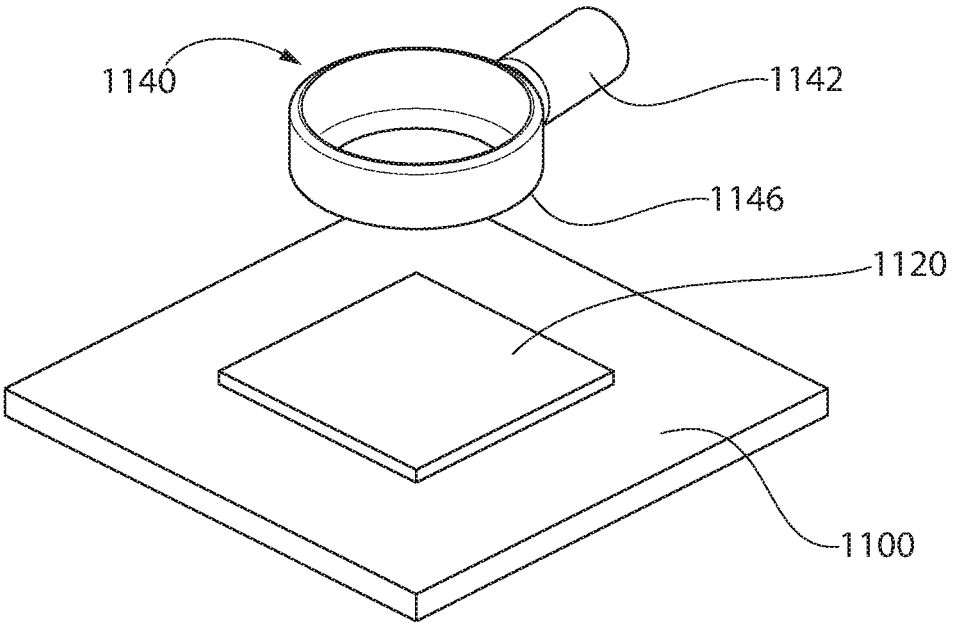
FIG. 17 is a perspective view of an induction air mover positioned above a ceiling panel that includes a thermal mass.
Figure 18:
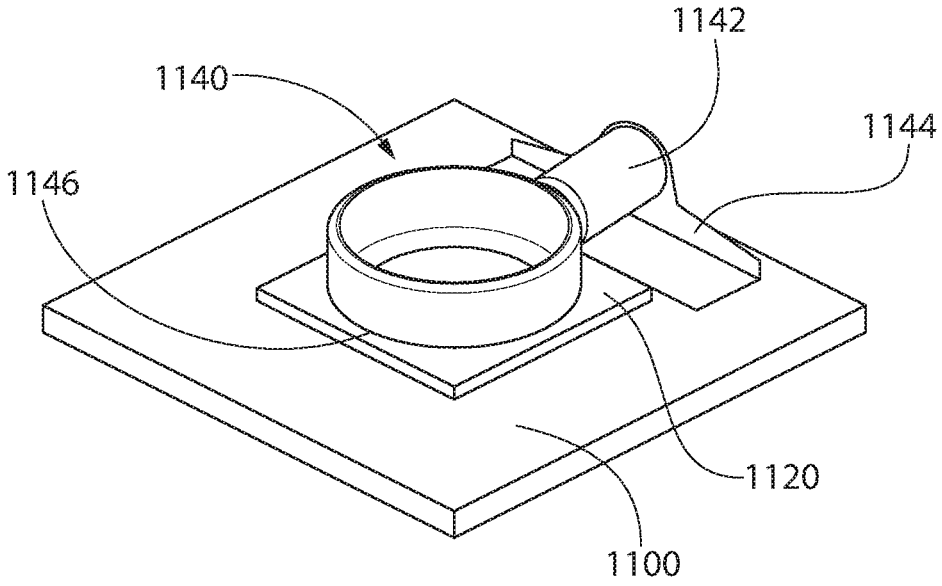
FIG. 18 is a perspective view of an induction air mover attached to a ceiling panel that includes a thermal mass.

FIGS. 17 and 18 show an example of an air moving system 110 that has a fan that moves air over a phase change material to induce more thermal transfer to and/or from the phase change material. In this example, an induction fan 1140 has a motor 1142, and an outlet 1146 at its lower edge. A phase change material 1120 is attached to the upper side of a ceiling panel. Fan 1140 moves air over phase change material 1120 to promote increased thermal transfer. The ceiling panel can be any type of ceiling panel such as, for example, a canopy type, a cloud type, a drop in panel in a grid system, or other type of ceiling panel.

FIG. 17 shows an example where fan 1140 is separate from the ceiling panel whereas FIG. 18 shows an example where fan 1140 is attached to the ceiling panel by a mount 1144. In both examples, a space exists between outlet 1146 of fan 1140 and phase change material 1120.

Phase change material 1120 can be a material that changes from a solid to a liquid as it absorbs heat or a material that changes from a liquid to a gas as it absorbs heat. An example of an appropriate phase change material is a salt hydrate phase change material composed of water mixed with calcium chloride and a nucleating agent. Any appropriate phase change material can be used.

Figure 19:
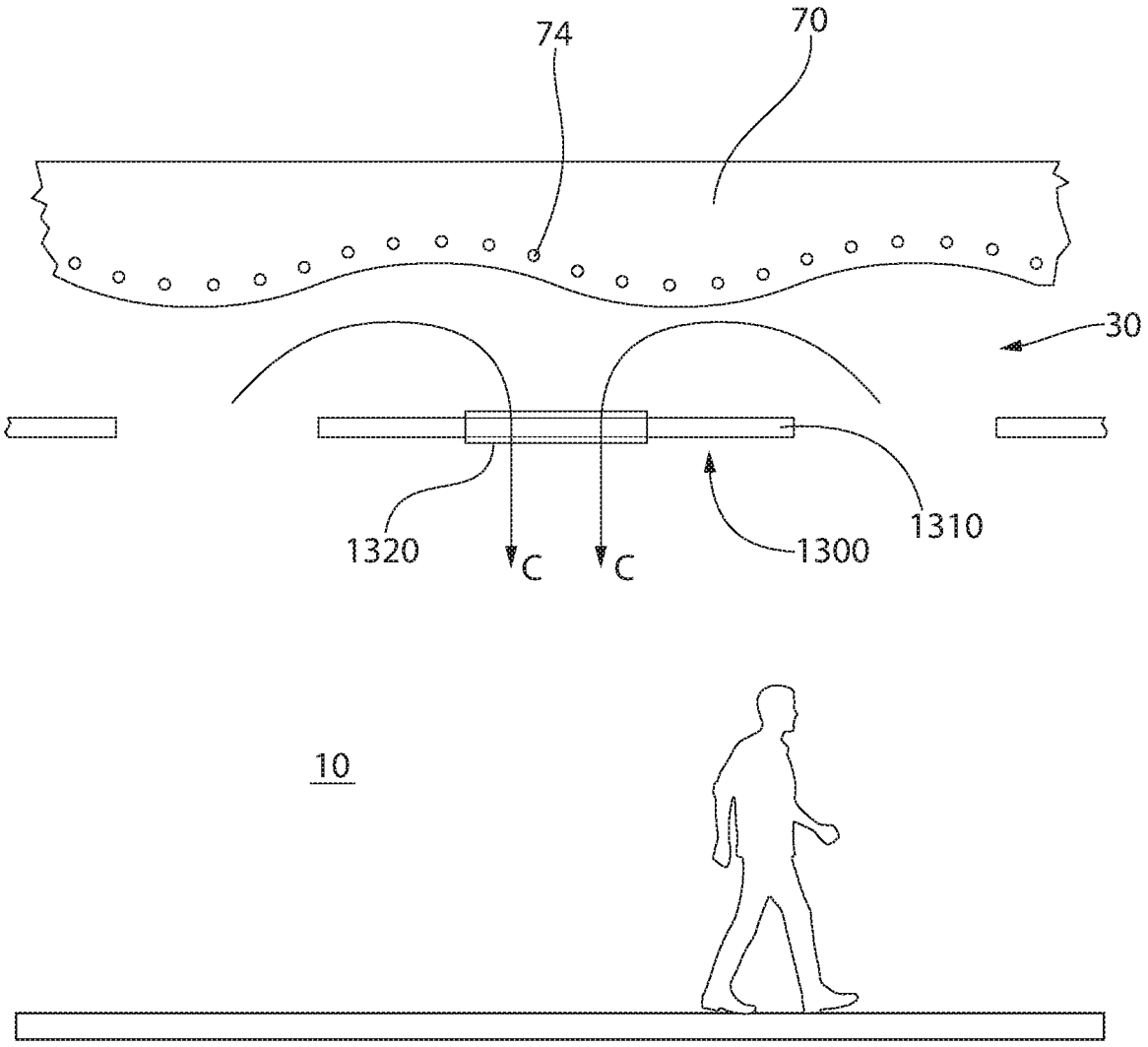
FIG. 19 is a side view of ceiling system having an air mover that moves air across a radiant surface.

FIG. 19 shows an example of an air moving system 1300 that is used with a radiant surface to promote thermal transfer to/from the radiant surface. In this example, radiant surface 70 has a plurality of conduits 74 that are embedded in the structure behind radiant surface 70. Conduits 74 can carry a liquid or a gas through the structure to heat or cool radiant surface 70. As stated above, a problem with radiant surfaces is that air flow is needed to transfer heat to/from the radiant surface. The embodiment shown in FIG. 19 provides air moving system 1300 to move air across radiant surface 70. Air moving system 1300 includes an air mover 1320 that is mounted in a ceiling panel 1310 (in this example, a canopy type panel). Air moving system 1300 draws air from plenum space 30 over radiant surface 70 and projects it down into occupied space 10 (represented by arrows C). In this example, air mover 1320 is an inductive air mover. Examples such as this provide increased thermal transfer to/from the radiant surface in an unobtrusive system that has no visible moving parts.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention.

What is claimed is:

1. A ceiling system comprising:

a ceiling structure suspended within a space of a building thereby dividing the space into an occupied space below the ceiling structure and a plenum space above the ceiling structure;

a panel structure supported by the ceiling structure and having an opening;

a pressurized air passageway aligned with the opening, the pressurized air passageway fed pressurized air from the plenum space and having an outlet facing the occupied space; and an inductive air passageway adjacent to the pressurized air passageway, the inductive air passageway having an inlet facing the panel structure and which draws air from the occupied space and further contains an outlet, wherein the pressurized air passageway and the inductive air passageway are configured such that pressurized air passing through the outlet of the pressurized air passageway induces an induced air flow out of the outlet of the inductive air passageway;

wherein the pressurized air passing through the outlet of the pressurized air passageway and the induced airflow out of the outlet of the inductive air passageway mixes and is distributed into the occupied space, and wherein said inductive air passageway outlet is adjacent to said pressurized air passageway outlet.

2. The ceiling system of claim 1, wherein the panel structure is an acoustical panel structure.

3. The ceiling system of claim 1, wherein the panel structure is a canopy-type panel structure that is configured such that the panel structure is spaced away from a wall of the occupied space.

4. The ceiling system of claim 1, wherein the pressurized air and the induced air flow mix together at the outlet of the pressurized air passageway.

5. The ceiling system of claim 1, wherein the pressurized air passageway is fluidly connected to an air supply space that pushes air through ductwork that is located in the plenum space.

6. The ceiling system of claim 1, further comprising:

a plurality of the panel structure;

wherein the pressurized air passageway and the inductive air passageway are attached to an edge of one of the plurality of panel structures; and the pressurized air passageway and the inductive air passageway are located between two adjacent ones of the plurality of panel structures.

7. The ceiling system of claim 1, further comprising a phase change material attached to, or integral with, the panel structure; and wherein the phase change material comprises a salt hydrate and a nucleating agent.

8. The ceiling system of claim 1, further comprising a water evaporation device, the water evaporation device being configured to present water to the pressurized air or the inductive air flow.

9. The ceiling system of claim 1, wherein the pressurized air is heated or cooled.

10. A ceiling system comprising:

a ceiling structure suspended within a space of a building thereby dividing the space into an occupied space below the ceiling structure and a plenum space above the ceiling structure;

a first panel structure supported by the ceiling structure and having an edge;

a pressurized air passageway attached to the edge of the first panel structure, the pressurized air passageway having an inlet which draws air from the plenum space and an outlet facing the occupied space;

an inductive air passageway adjacent the pressurized air passageway, the inductive air passageway being attached to the edge of the first panel structure and having an inlet facing the panel structure and which draws air from the occupied space and an outlet; and wherein the pressurized air passageway and the inductive air passageway are configured such that pressurized air passing through the outlet of the pressurized air passageway induces an induced air flow out of the outlet of the inductive air passageway;

wherein the pressurized air passing through the outlet of the pressurized air passageway and the induced airflow out of the outlet of the inductive air passageway mixes and is distributed into the occupied space, and wherein said inductive air passageway outlet is adjacent to said pressurized air passageway outlet.

11. The ceiling system of claim 10, wherein the first panel structure is oriented in a baffle-style arrangement such that the edge of the first panel structure is a lowest edge of the first panel structure, and the inductive air passageway is located below the edge of the first panel structure.

12. The ceiling system of claim 10, further comprising a second panel structure supported by the ceiling structure, wherein the second panel structure has a lower edge;

the first panel structure and the second panel structure are oriented in a baffle-style arrangement; and the first panel structure and the second panel structure are attached to each other such that the inductive air passageway is attached to and is located below the lower edge of the first panel structure and the lower edge of the second panel structure.

13. The ceiling system of claim 10, further comprising a phase change material attached to, or integral with, the first panel structure;

wherein the phase change material comprises calcium chloride, a nucleating agent, and water.

14. The ceiling system of claim 10, further comprising a water evaporation device, the water evaporation device being configured to present water to the pressurized air or the inductive air flow.

15. The ceiling system of claim 10, wherein the pressurized air is heated or cooled.

16. A ceiling system comprising:

a ceiling structure suspended within a space of a building thereby dividing the space into an occupied space below the ceiling structure and a plenum space above the ceiling structure;

a panel structure supported by the ceiling structure and having an opening;

a radiant surface comprising a plurality of conduits, the radiant surface located within the plenum space; and a pressurized air passageway aligned with the opening, the pressurized air passageway configured to flow pressurized air from the plenum space into a venturi and out of an outlet which faces the occupied space;

wherein the pressurized air passageway is configured such that pressurized air passing through the outlet of the pressurized air passageway induces an induced air flow;

further comprising an inductive air passageway adjacent the pressurized air passageway, the inductive air passageway having an inlet facing the plenum space and further contains an outlet, wherein the pressurized air passageway and the inductive air passageway are configured such that the pressurized air passing through the outlet of the pressurized air passageway induces the induced air flow out of the outlet of the inductive air passageway;

wherein the pressurized air passageway and the inductive air passageway are located within a field area of the panel structure, the field area of the panel structure being an area away from all edges of the panel structure; and wherein said inductive air passageway outlet is adjacent to said pressurized air passageway outlet.

17. The ceiling system of claim 16, wherein the induced air flow is air from the plenum that flows through the inductive air passageway.

18. The ceiling system of claim 16, wherein the pressurized air passageway is ring shaped, and the outlet is a slot in the lower side of the ring shape.

* * * * *